US005392539A

United States Patent [19]

Hirata et al.

[11] Patent Number: 5,392,539

[45] Date of Patent: Feb. 28, 1995

[54] HYDRAULIC DRIVE SYSTEM FOR CONSTRUCTION MACHINE

[75] Inventors: Toichi Hirata, Ushiku; Genroku Sugiyama, Ibaraki; Masami Ochiai, Atsugi, all of Japan

[73] Assignee: Hitachi Construction Machinery Co., Ltd., Tokyo, Japan

[21] Appl. No.: 75,588

[22] PCT Filed: Dec. 22, 1992

[86] PCT No.: PCT/JP92/01676

§ 371 Date: Jun. 15, 1993

§ 102(e) Date: Jun. 15, 1993

[87] PCT Pub. No.: WO93/13271

PCT Pub. Date: Jul. 8, 1993

[30] Foreign Application Priority Data

Dec. 24, 1991 [JP] Japan ..... 3-341367
Dec. 24, 1991 [JP] Japan ..... 3-341369

[51] Int. Cl.[6] ..... F16D 31/02; G06F 15/20

[52] U.S. Cl. ..... 37/348; 60/431; 60/422; 60/420; 414/697; 414/699; 417/19

[58] Field of Search ..... 37/348, 103, DIG. 1; 60/422, 432, 426, 420; 414/697; 417/19, 218, 222, 34; 91/517, 518, 519, 526

[56] References Cited

U.S. PATENT DOCUMENTS

| | | | |
|---|---|---|---|
| 3,981,618 | 9/1976 | Nelson, Jr. | 417/12 |
| 3,987,624 | 10/1976 | Cooke et al. | 60/431 |
| 4,118,149 | 10/1978 | Hagberg | 417/26 |
| 4,330,238 | 5/1982 | Hoffman | 417/19 |
| 4,534,707 | 8/1985 | Mitchell | 417/34 |
| 4,561,824 | 12/1985 | Okabe et al. | 414/697 |
| 4,617,854 | 10/1986 | Kropp | 91/517 |
| 4,635,440 | 1/1987 | Kropp | 60/422 |
| 4,742,676 | 5/1988 | Kropp et al. | 60/432 |
| 4,884,402 | 12/1989 | Strenzke et al. | 60/426 |
| 5,065,326 | 11/1991 | Sahm | 37/348 X |
| 5,081,838 | 1/1992 | Miyaoka et al. | 37/348 X |
| 5,155,996 | 10/1992 | Tatsumi et al. | 417/34 X |
| 5,170,342 | 12/1992 | Nakamura et al. | 37/348 X |

FOREIGN PATENT DOCUMENTS

| | | |
|---|---|---|
| 60-188604 | 9/1985 | Japan . |
| 2-248705 | 10/1990 | Japan . |

*Primary Examiner*—Randolph A. Reese
*Assistant Examiner*—Robert Pezzuto
*Attorney, Agent, or Firm*—Fay, Sharpe, Beall, Fagan, Minnich & McKee

[57] ABSTRACT

In a hydraulic drive system for a construction machine, first flow control mechanism includes first and second flow control valves (11*a*, 11*b*) and first interlock mechanism (54, 55) for interlocking the first and second flow control valves with first directional control mechanism (7), and second flow control mechanism includes third and fourth flow control valves (12*a*, 12*b*) and second interlock mechanism (56, 57) for interlocking the third and fourth flow control valves with second directional control mechanism (9). First pressure control mechanism includes at least first pressure control valve (13*a*) operated in response to a pressure signal in a valve-closing direction, and second pressure control mechanism includes only second pressure control valve (15*b*) operated in response to the pressure signal in a valve-closing direction. A first hydraulic pump (25*a*) is connected to a first actuator (19) via the first flow control valve (11*a*), the first pressure control valve (13*a*) and the first directional control mechanisms (7), and a second hydraulic pump (25*b*) is connected to the first actuator (19) via the second flow control valve (11*b*) and the first directional control mechanism (7). The first hydraulic pump (25*a*) is also connected to a second actuator (21) via the third flow control valve (12*a*) and the second directional control mechanism (9) in parallel to the first actuator (19) without passing any pressure control valve, and the second hydraulic pump (25*b*) is also connected to the second actuator (21) via the fourth flow control valve (12*b*), the second pressure control valve (15*b*) and the second directional control mechanism (9) in parallel to the first actuator (19).

6 Claims, 10 Drawing Sheets

HYDRAULIC DRIVE SYSTEM FOR CONSTRUCTION MACHINE

TECHNICAL FIELD

The present invention relates to a hydraulic drive system equipped on construction machines such as hydraulic excavators, and more particularly to a hydraulic drive system for construction machines which can simultaneously drive a plurality of actuators.

BACKGROUND OF THE INVENTION

One of conventional hydraulic drive systems for construction machines which can simultaneously drive a plurality of actuators is disclosed in JP, A, 2-248705. The disclosed hydraulic drive system comprises first and second hydraulic pumps, first and second actuators driven by a hydraulic fluid supplied from the first and second hydraulic pumps, and first and second valve apparatus respectively disposed between the first and second hydraulic pumps and the first and second actuators for selectively controlling operation of the first and second actuators. The first valve apparatus includes a first flow control valve and a first directional control valve cooperating each other, and a first pressure control valve disposed between the first flow control valve and the first directional control valve. The second valve apparatus includes second and third flow control valves and a second directional control valve cooperating one another, and a second pressure control valve disposed between the second and third flow control valves and the second directional control valve. The first hydraulic pump is connected to the first actuator via the first flow control valve, the first pressure control valve and the first directional control valve, as well as to the second actuator via the second flow control valve, the second pressure control valve and the second directional control valve in parallel to the first actuator. The second hydraulic pump is solely connected to the second actuator via the third flow control valve, the second pressure control valve and the second directional control valve. With such an arrangement, only the hydraulic fluid delivered from the first hydraulic pump is supplied to the first actuator, while the hydraulic fluid delivered from the first hydraulic pump and the hydraulic fluid delivered from the second hydraulic pump are joined and then supplied to the second actuator. The hydraulic fluid delivered from the first hydraulic pump and the hydraulic fluid delivered from the second hydraulic pump are joined between the second and third flow control valves and the second pressure control valve.

The above hydraulic drive system also comprises a pressure signal transmitting line for introducing higher one of load pressures of the first and second actuators, as a pressure signal, to drive sectors of the first and second pressure control valves. In response to the pressure signal, the first and second pressure control valves operate in valve-closing directions such that the first pressure control valve controls a pressure downstream of the first flow control valve and the second pressure control valve controls a pressure downstream of the second and third flow control valves.

Further, the above hydraulic drive system comprises first and second pump regulators for controlling delivery rates of the first and second hydraulic pumps, respectively. The first and second pump regulators are supplied with, as a pressure signal, higher one of the load pressures of the first and second actuators via the aforesaid pressure signal transmitting line to control the delivery rates of the first and second hydraulic pumps so that delivery pressures of the first and second hydraulic pumps are held higher than the pressure signal.

In the hydraulic drive system thus constructed, the combined operation of the first and second actuators can be surely performed even when the load pressures of the first and second actuators are different from each other. For example, when the first actuator is driven at 200 bar on the higher load pressure side and the second actuator is driven at 100 bar on the lower load pressure side, the higher load pressure of 200 bar is introduced to the pressure signal transmitting line. Therefore, the first and second pump regulators cause the delivery pressures of the first and second hydraulic pumps to be held at a pressure, e.g., 220 bar, higher a fixed value than 200 bar. At this time, the pressure of 200 bar is also introduced to the drive sectors of the first and second pressure control valves via the pressure signal transmitting line so that pressures upstream of the first and second pressure control valves, i.e., pressures downstream of the first flow control valve and the second and third flow control valves, are held at 200 bar. Thus, since pressures upstream of the first flow control valve and the second and third flow control valves are all equal to the pump delivery pressure and the pressures downstream thereof are all equal to 200 bar, differential pressures across these flow control valves are equal to one another. The flow rate of the hydraulic fluid delivered from the first hydraulic pump is distributed in accordance with opening ratios of the first and second flow control valves, and the flow rate of the hydraulic fluid delivered from the second hydraulic pump is provided to the second actuator depending on an opening of the third flow control valve. As a result, the distributed flow rate of the hydraulic fluid from the first hydraulic pump is supplied to the first actuator via the first directional control valve, the distributed flow rate of the hydraulic fluid from the first hydraulic pump and the flow rate of the hydraulic fluid from the second hydraulic pump are joined and then supplied to the second actuator via the second directional control valve, thereby enabling the first and second actuators to be driven simultaneously.

DISCLOSURE OF THE INVENTION

In the foregoing prior art, however, when the hydraulic drive system is shifted in its driving mode from the sole operation of the second actuator on the lower pressure side to the combined operation of the first and second actuators undergoing a large difference between their load pressures as mentioned above, for example, the load pressure of the first actuator on the higher pressure acts, as a signal pressure, on the drive sector of the second pressure control valve associated with the second actuator on the lower pressure side, whereupon the opening of the second pressure control valve is restricted abruptly. At the same time, the load pressure of the first actuator on the higher pressure is also introduced, as a signal pressure, to the first and second pump regulators which control the delivery rates of the first and second hydraulic pumps, respectively, so that their delivery pressures are held higher than the signal pressure. But there is a response delay in the above control of the hydraulic pumps. Because of such a response delay, the flow rate of the hydraulic fluid supplied to the second actuator is transiently lowered so abruptly that the actuator's operating speed may decrease to a large extent.

Assuming that the first and second actuators are respectively a bucket cylinder for driving a bucket of a hydraulic excavator and a boom cylinder for driving a boom thereof, by way of example, when the driving mode is shifted from the sole operation of the boom to the combined operation of the boom cylinder and the bucket cylinder in which a large weight is to be moved by the bucket while operating the boom, it may occur that the boom operation is transiently slowed with the bucket cylinder being on the higher pressure side.

Alternatively, on an assumption that the first and second actuators are respectively a boom cylinder for driving the boom and a breaker cylinder for driving a breaker, by way of another example, when the driving mode is shifted from the sole operation of the breaker cylinder for hitting the breaker;to the combined operation of the breaker cylinder and the boom cylinder in which the breaker is to be hit while pressing the breaker by the boom, it may occur that the operating speed of the breaker cylinder is transiently lowered abruptly with the boom cylinder being on the higher pressure side, leading to a reduction in the number of times that the breaker is hit.

Further, the first and second pump regulators for controlling the delivery rates of the first and second hydraulic pumps are generally provided with an input torque limit controlling mechanism to diminish maximum displacements of the hydraulic pumps for reducing the pump delivery rates, when the pump delivery pressure is high on one side, so that outputs of the first and second hydraulic pumps will not exceed the output of a prime mover-for driving them. In this case, the delivery rates of the first and second hydraulic pumps are controlled in accordance with the load pressure of the first actuator on the higher pressure side such that the pump delivery rates are extremely reduced when the load pressure of the first actuator becomes large. Meanwhile, during the combined operation of two actuators undergoing a large difference between their load pressures, it is often desirable to set a higher operating speed of the actuator on the lower pressure side and a lower operating speed of the actuator on the higher pressure side for carrying out work. Accordingly, if the pump delivery pressure is extremely lowered during the combined operation of the first and second actuators, the flow rate of the hydraulic fluid supplied to the second actuator with the lower load pressure is so reduced that the operating speed may become slow.

In the above example that the first and second actuators are respectively a bucket cylinder for driving a bucket of a hydraulic excavator and a boom cylinder for driving a boom thereof, the boom operation may be slowed during the combined operation in which the boom is operated while relieving the bucket cylinder.

Also, in the above alternative example that the first and second actuators are respectively a boom cylinder for driving the boom and a breaker cylinder for driving a breaker, the operating speed of the breaker cylinder on the lower pressure side may be extremely lowered and the number of times that the breaker is hit may be reduced during the combined operation in which the breaker is to be hit while pressing the breaker by the boom.

Such a reduction in the flow rate of the hydraulic fluid supplied to the second actuator on the lower pressure side upon shift from the sole operation to the combined operation and during the combined operation is more significant with the larger difference in load pressure between the first and second actuators. Eventually, the above-mentioned prior art has suffered from the problem that the lowered operating speed of the second actuator on the lower pressure side reduces efficiency of entire work to be carried out by both the first and second actuators.

Moreover, during the combined operation of the first and second actuators, the second pressure control valve associated with the second actuator on the lower pressure side is extremely restricted. This increases a pressure loss, generates heat and further deteriorates heat balance in the circuit. Accordingly, the hydraulic fluid is deteriorated because of its raised temperature and the energy loss that does not effectively contribute to operation of the hydraulic pumps is increased, which results in the problem that the prime mover for driving the hydraulic pumps requires the higher fuel cost.

While the above description is made as using the first and second two actuators for the sake of simplicity, the same problem arises in a hydraulic drive system equipped with three or more actuators, when two or more actuators producing different load pressures are to be simultaneously driven.

Also, while the pump regulator is explained above as introducing the load pressure of the actuator to the pump regulator and controlling the pump delivery rate so that the delivery pressure of the hydraulic pump is held higher than the load pressure of the actuator, the same problem arises in other type pump regulators.

For example, there is a system in which an actuator's load pressure is introduced to an unloading valve connected to a pump delivery line, and a delivery pressure of a hydraulic pump is controlled by the unloading valve so that the pump delivery pressure is held higher than the actuator's load pressure. There also exists a system in which an input amount of a control lever is applied for increasing a pump delivery rate with an increase in the input amount. In these systems, too, a response delay in control occurs similarly to the above-mentioned case and, therefore, the same problem arises upon shift from the sole operation to the combined operation. Further, when an input torque limiting mechanism for the hydraulic pump is added to any of those systems, the problem of reducing the flow rate of the hydraulic fluid supplied to the actuator with the lower load pressure is caused during the combined operation.

An object of the present invention is to provide a hydraulic drive system for a construction machine with which, upon shift from sole operation of a single hydraulic actuator to combined operation of plural hydraulic actuators, a transient reduction in the flow rate of a hydraulic fluid supplied to the actuator on the lower pressure side can be prevented.

Another object of the present invention is to provide a hydraulic drive system for a construction machine with which, during combined operation of plural hydraulic actuators, an extreme reduction in the flow rate of a hydraulic fluid supplied to the actuator on the lower pressure side can be prevented.

Still another object of the present invention is to provide a hydraulic drive system for a construction machine with which, during combined operation of plural hydraulic actuators, a pressure loss due to a pressure control valve is suppressed and generation of heat is held down for improving heat balance in a circuit.

To achieve the above object, in accordance with the present invention, there is provided a hydraulic drive system for a construction machine comprising at least first and second hydraulic pumps, at least first and second actuators driven by a hydraulic fluid supplied from said first and second hydraulic pumps, first and second valve apparatus respectively disposed between said first and second hydraulic pumps and said first and second actuators for selectively controlling operation of said first and second actuators, and first and second pump control means for respectively controlling said first and second hydraulic pumps so that pump delivery pressures are held higher than higher one of load pressures of said first and second actuators, said first and second valve apparatus respectively including first and second flow control means, first and second pressure control means, and first and second directional control means arranged in this order, said hydraulic drive system further comprising a pressure signal transmitting line for introducing, as a pressure signal, higher one of the load pressures of said first and second actuators to said first and second pressure control means, said first and second pressure control means being operated in response to said pressure signal to respectively control pressures downstream of said first and second flow control means, wherein said first flow control means includes first and second flow control valves and first interlock means for interlocking said first and second flow control valves with said first directional control means, and said second flow control means includes third and fourth flow control valves and second interlock means for interlocking said third and fourth flow control valves with said second directional control means; said first pressure control means includes at least first pressure control valve operated in response to said pressure signal in a valve-closing direction, and said second pressure control means includes only second pressure control valve operated in response to said pressure signal in a valve-closing direction; and said first hydraulic pump is connected to said first actuator via said first flow control valve, said first pressure control valve and said first directional control means, said second hydraulic pump is connected to said first actuator via said second flow control valve and said first directional control means, said first hydraulic pump is also connected to said second actuator in parallel to said first actuator via said third flow control valve and said second directional control means without passing any pressure control valve, and said second hydraulic pump is also connected to said second actuator in parallel to said first actuator via said fourth flow control valve, said second pressure control valve and said second directional control means.

In the hydraulic drive system of the present invention thus constructed, assuming that the first actuator is an actuator of higher load pressure and the second actuator is an actuator of lower load pressure, because no pressure control valve is provided between the third flow control valve communicating with the first hydraulic pump and the second directional control valve, most of the hydraulic fluid from the first hydraulic pump is supplied to the second actuator via the third flow control valve and the second directional control valve when the first and second actuators are driven simultaneously. Also, because the delivery pressure of the first hydraulic pump is dominated by the load pressure of the second actuator on the lower pressure side, the delivery pressure of the first hydraulic pump will not so rise, allowing the first hydraulic pump to maintain a sufficient delivery rate in spite of that the first and second pump control means are provided with input torque limiting control means. Therefore, the hydraulic fluid is supplied to the second actuator of lower load pressure at a sufficient flow rate, with the result of improved working efficiency during the combined operation of both the actuators.

Also, with no pressure control valve provided between the third flow control valve communicating with the first hydraulic pump and the second directional control valve, upon shift from the sole operation of the second actuator of lower load pressure to the combined operation of both the first and second actuators, the flow rate of the hydraulic fluid supplied to the second actuator of lower load pressure can be prevented from reducing transiently, which also contributes to an improvement in the working efficiency.

In the above hydraulic drive system, said first pressure control means may further include a third pressure control valve operated in response to said pressure signal in a valve-closing direction. In this case, said second hydraulic pump is connected to said first actuator via said second flow control valve, said third pressure control valve and said first directional control means.

Also, said first pressure control means may include only said first pressure control valve, and said second hydraulic pump may be connected to said first actuator via said second flow control valve and said first directional control means without passing any pressure control valve.

With such an arrangement, even when the load pressures of the first and second actuators are reversed in their magnitudes, the hydraulic drive system operates similarly to the above during the combined operation and upon shift from the sole operation of the actuator of lower load pressure to the combined operation.

Preferably, lines downstream of said first and second flow control valves are connected to each other such that the hydraulic fluid delivered from said first hydraulic pump and the hydraulic fluid delivered from said second hydraulic pump join together between said first pressure control valve and said first directional control means, while lines downstream of said third and fourth flow control valves are connected to each other such that the hydraulic fluid delivered from said first hydraulic pump and the hydraulic fluid delivered from said second hydraulic pump join together between said second pressure control valve and said second directional control means.

The lines downstream of said first and second flow control valves may be connected to each other such that the hydraulic fluid delivered from said first hydraulic pump and the hydraulic fluid delivered from said second hydraulic pump join together between said first directional control means and said first actuator, while the lines downstream of said third and fourth flow control valves are connected to each other such that the hydraulic fluid delivered from said first hydraulic pump and the hydraulic fluid delivered from said second hydraulic pump join together between said second directional control means and said second actuator.

Preferably, said first and second pump control means respectively include first delivery rate control means for controlling a delivery rate of said first hydraulic pump so that a pump delivery pressure is held higher than said pressure signal and second delivery rate control means for controlling a delivery rate of said second hydraulic pump so that a pump delivery pressure is held higher than said pressure signal.

Note that the pump control means may be of any other suitable means than described above so long as it can make control so that the pump delivery pressure is held higher than higher one of the load pressures of the first and second actuators. Other type pump control means include, for example, means for directly controlling the pump delivery pressure by the use of the aforesaid unloading valve, and means for receiving the input amount of a control lever and controlling the pump delivery rate.

BEST MODE FOR CARRYING OUT THE PRESENT INVENTION

First Embodiment

A first embodiment of the present invention will be described below with reference to FIGS. 1 to 3.

Figure 1:
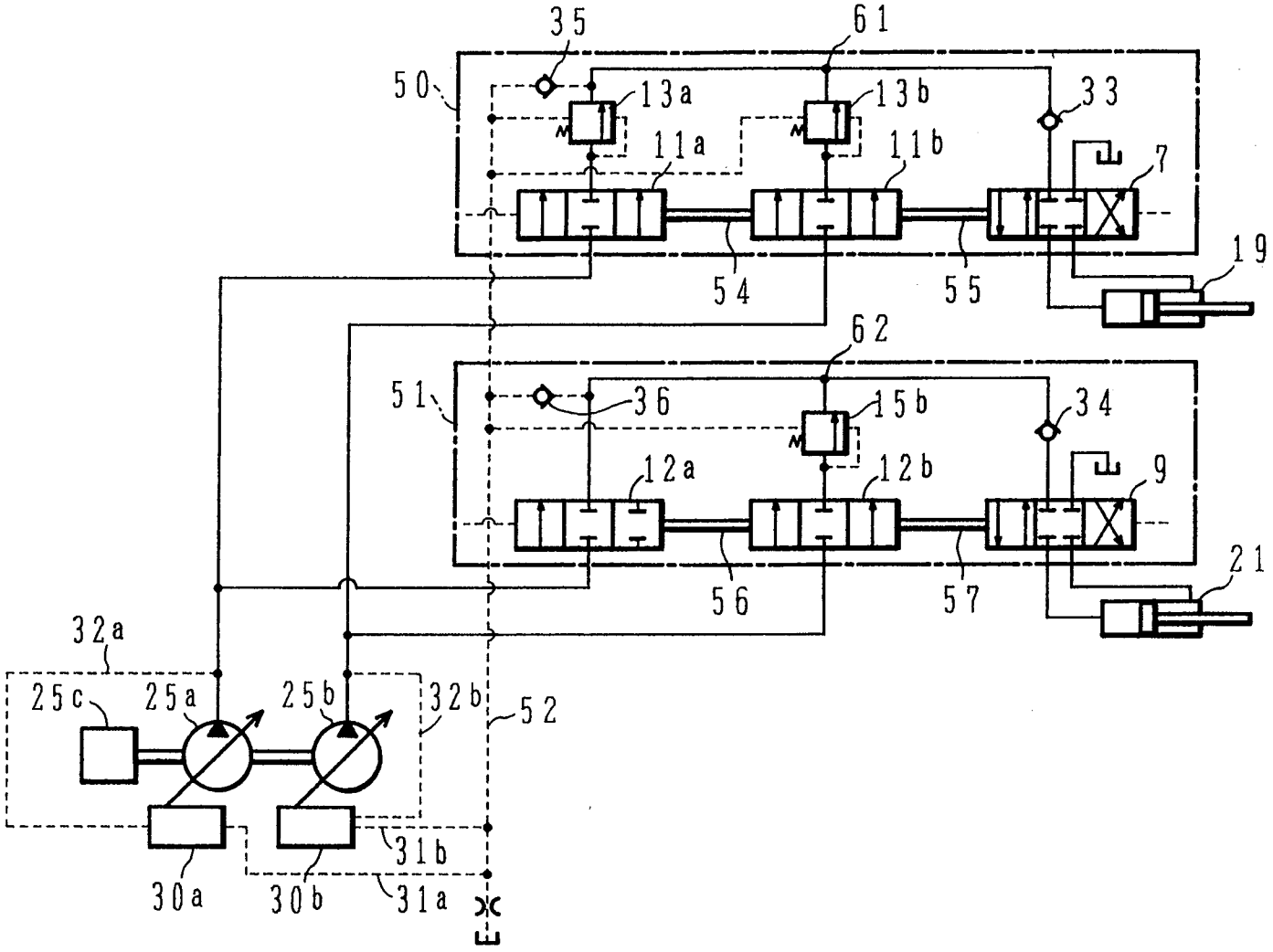
FIG. 1 is a circuit diagram showing the construction of a hydraulic drive system for a construction machine according to a first embodiment of the present invention.

In FIG. 1, a hydraulic drive systems for construction machines comprises a prime mover 25*c*, a plurality of hydraulic pumps, e.g., a first variable displacement hydraulic pump 25*a* and a second variable displacement hydraulic pump 25*b*, driven by the prime mover 25*c*, a plurality of actuators, e.g., a first actuator 19 and a second actuator 21, driven by a hydraulic fluid supplied from those hydraulic pumps 25*a*, 25*b*, a first valve apparatus 50 disposed between the hydraulic pumps 25*a*, 25*b* and the first actuator 19 and a second valve apparatus 51 disposed between the hydraulic pumps 25*a*, 25*b* and the second actuator 21, as well as a first delivery rate controller 30*a* and a second delivery rate controller 30*b* for respectively controlling delivery rates of the hydraulic pumps 25*a*, 25*b*.

The first valve apparatus 50 includes a first flow control valve 11*a*, a second flow control valve 11*b* and a first directional control valve 7 coupled to each other via rods 54, 55 which constitute first interlock means, a first pressure control valve 13*a*, and a second pressure control valve 13*b*. The first flow control valve 11*a* is communicated with the first hydraulic pump 25*a*, the first pressure control valve 13*a* is communicated with a line downstream of the first flow control valve 11*a*, and further the first directional control valve 7 is communicated with a line downstream of the first pressure control valve 13*a*, the first directional control valve 7 being connected to the first actuator 19. The second flow control valve 11*b* is communicated with the second hydraulic pump 25*b*, the second pressure control valve 13*b* is communicated with a line downstream of the second flow control valve 11*b*, and further the first directional control valve 7 is communicated with a line downstream of the second pressure control valve 13*b*.

Thus, the first hydraulic pump 25*a* is connected to the first actuator 19 via the first flow control valve 11*a*, the first pressure control valve 13*a* and the first directional control valve 7, while the second hydraulic pump 25*b* is connected to the first actuator 19 via the second flow control valve 11*b* the second pressure control valve 13*b* and the first directional control valve 7. Further, the lines downstream of the first and second flow control valves 11*a*, 11*b* are connected to each other such that a junction 61 of the hydraulic fluid delivered from the first hydraulic pump 25*a* and the hydraulic fluid delivered from the second hydraulic pump 25*b* is located between the first and second pressure control valve 13*a*, 13*b* and the first directional control valve 7.

The second valve apparatus 51 includes a third flow control valve 12*a*, a fourth flow control valve 12*b* and a second directional control valve 9 coupled to each other via rods 56, 57 which constitute second interlock means, and a third pressure control valve 15*b*. The third flow control valve 12*a* is communicated with the first hydraulic pump 25*a* and the second directional control valve 9 is communicated with a line downstream of the third flow control valve 12*a*, the second directional control valve 9 being connected to the second actuator 21. The fourth flow control valve 12*b* is communicated with the second hydraulic pump 25*b*, the third pressure control valve 15*b* is communicated with a line downstream of the fourth flow control valve 12*b*, and further the second directional control valve 9 is communicated with a line downstream of the third pressure control valve 15*b*.

Thus, the first hydraulic pump 25*a* is also connected to the second actuator 21 via the third flow control valve 12*a* and the second directional control valve 9 in parallel to the first actuator 19 with no pressure control valve downstream of the third flow control valve 12*a*.

The second hydraulic pump 25b is also connected to the second actuator 21 via the fourth flow control valve 12b, the third pressure control valve 15b and the second directional control valve 9 in parallel to the first actuator 19. Further, the lines downstream of the third and fourth flow control valves 12a, 12b are connected to each other such that a junction 62 of the hydraulic fluid delivered from the first hydraulic pump 25a and the hydraulic fluid delivered from the second hydraulic pump 25b is located between the third flow control valve 12a as well as the third pressure control valve 15b and the second directional control valve 9.

Between the junction 61 and the first directional control valve 7 is disposed a first load check valve 33 for preventing a reverse flow of the hydraulic fluid from the first actuator 19, and between the junction 62 and the second directional control valve 9 is disposed a second load check valve 34 for preventing a reverse flow of the hydraulic fluid from the second actuator 21.

The hydraulic drive system of this embodiment also comprises a pressure signal transmitting line 52. The pressure signal transmitting line 52 is connected to the line downstream of the first pressure control valve 13a and the line downstream of the third flow control valve 12a via check valves 35, 36, respectively. Therefore, higher one of load pressures of the first actuator 19 and the second actuator 21 is taken out, as a pressure signal, to the pressure signal transmitting line 52 via the check valves 35, 36.

A drive sector of the first pressure control valve-13a is connected to the pressure signal transmitting line 52, whereby the first pressure control valve 13a is controlled so that a pressure upstream of the first pressure control valve 13a, i.e., a pressure downstream of the first flow control valve 11a, becomes equal to the aforesaid higher load pressure provided as a signal pressure through the pressure signal transmitting line 52. Likewise, respective drive sectors of the second and third pressure control valves 13b, 15b are connected to the pressure signal transmitting line 52, whereby the second and third pressure control valve 13b, 15b are controlled so that pressures downstream of the second and fourth flow control valves 11b, 12b become equal to the aforesaid higher load pressure provided as the signal pressure through the pressure signal transmitting line 52.

The first delivery rate controller 30a and the second delivery rate controller 30b are connected to the pressure signal transmitting line 52 via lines 31a, 31b and to delivery lines of the first and second hydraulic pumps 25a, 25b via lines 32a, 32b, respectively, and they control the delivery rates of the first and second hydraulic pumps 25a, 25b so that pump delivery pressures are held higher a fixed value than the aforesaid higher load pressure provided as the signal pressure through the pressure signal transmitting line 52.

Figure 2:
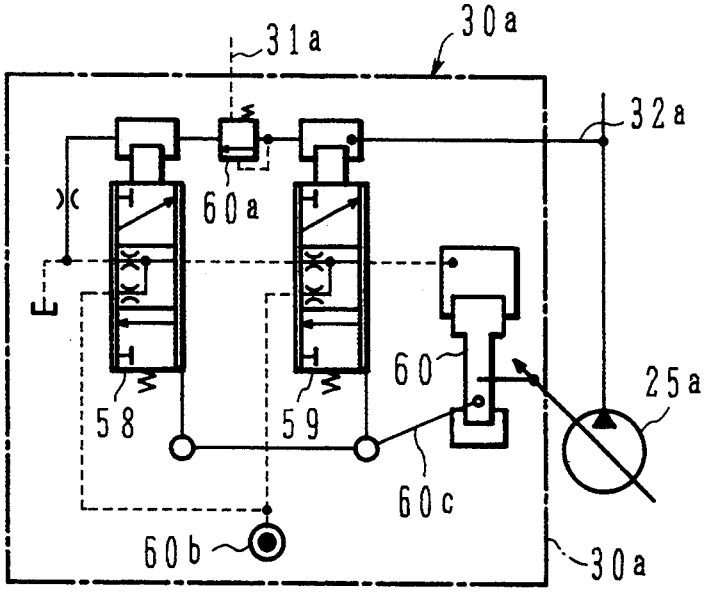
FIG. 2 is a circuit diagram showing the construction of delivery rate control means shown in FIG. 1.

As shown in FIG. 2, the first delivery rate controller 30a comprises, for example, a pressure control vale 60a which is operated to output the delivery pressure of the hydraulic pump 25a when the differential pressure between the delivery pressure of the hydraulic pump 25a introduced via the line 32a and the load pressure of the first actuator 19 introduced via the line 31a exceeds a set value, a servo valve 58 for load sensing control which is operated in response to the delivery pressure of the hydraulic pump 25a introduced via the pressure control valve 60a for changing the pump delivery rate, a servo valve 59 for input torque limiting control which is operated in response to the delivery pressure of the hydraulic pump 25a introduced via the line 32a for changing the pump delivery rate, a control actuator 60 for controlling a tilting angle (displacement volume) of the hydraulic pump 25a, a link mechanism 60c for interlocking the servo valves 58, 59 with the control actuator 60, and a hydraulic source 60b for supplying the hydraulic fluid to drive the control actuator 60 via the servo valves 58, 59. The second delivery rate controller 30b is of, for example, the same construction as the first delivery rate controller 30a.

The hydraulic drive system of this embodiment, constructed as explained above, operates as follows.

Let it be assumed that the hydraulic pumps 25a, 25b are driven with driving of the prime mover 25c. It is also assumed that when the first and second actuators 19, 21 are driven, the first actuator 19 produces a load pressure of 200 bar on the higher load pressure side and the second actuator 21 produces a load pressure of 100 bar on the lower load pressure side. On these assumptions, when control levers (not shown) of the first and second actuators 19, 21 are manipulated with an intention of driving the first and second actuators 19, 21, the rods 54, 55 cause the first directional control valve 7, the first flow control valve 11a and the second flow control valve 11b to be shifted in an interlocked manner, and the rods 56, 57 cause the second directional control valve 9, the third flow control valve 12a and the fourth flow control valve 12b to be shifted in an interlocked manner. The shifting direction at this time is assumed to make those flow control valves and directional control valves shifted to respective left-hand positions on the drawing. Upon the flow control valves and the directional control valves being thus shifted, the load pressure 200 bar of the first actuator 19 is introduced to the pressure signal transmitting line 52 and further introduced to the first delivery rate controller 30a and the second delivery rate controller 30b via the lines 31a, 31b. The delivery pressures of the first and second hydraulic pumps 25a, 25b are each thereby controlled to become a constant pressure, e.g., 220 bar, higher a fixed value than 200 bar. As described later, however, because no pressure control valve is provided between the third flow control valve 12a communicating with the first hydraulic pump 25a and the second directional control valve 9, the delivery pressure of the first hydraulic pump 25a is dominated by the load pressure of the second actuator 21 on the lower pressure side and does not reach 220 bar when an input amount to the third flow control valve 12a is large.

The load pressure of 200 bar introduced to the pressure signal transmitting line 52 as mentioned above is also applied to the drive sector of the first pressure control valve 13a, the drive sector of the second pressure control valve 13b and the drive sector of the third pressure control valve 15b. The first pressure control valve 13a, the second pressure control valve 13b and the third pressure control valve 15b are thereby operated to make the pressures upstream of the first pressure control valve 13a, the second pressure control valve 13b and the third pressure control valve 15b, i.e., the pressures downstream of the first flow control valve 11a, the second flow control valve 11b and the fourth flow control valve 12b, equal to the load pressure 200 bar of the first actuator 19. At this time, the pressures upstream of the second flow control valve 11b and the fourth flow control valve 12b are both equal to the delivery pressure of the second hydraulic pump 25b, i.e., 220 bar. Accordingly, the differential pressures across the second flow control valve 11b and the fourth flow control valve 12b are equal to each other so that the hydraulic fluid from the second hydraulic pump 25b is distributed in accordance with the opening ratio of the second flow control valve 11b to the fourth flow control valve 12b and then supplied to the first actuator 19 via the first directional control valve 7 and the second actuator 21 via the second directional control valve 9, respectively.

On the other hand, because no pressure control valve is provided between the third flow control valve 12a communicating with the first hydraulic pump 25a and the second directional control valve 9, most of the hydraulic fluid from the first hydraulic pump 25a is supplied to the second actuator 21 via the third flow control valve 12a and the second directional control valve 9 when an input amount to the third flow control valve 12a is large. In this case, the first delivery rate controller 30a attempts to control the delivery pressure of the first hydraulic pump 25a until reaching 220 bar in the same manner as explained above. However, with most of the hydraulic fluid from the first hydraulic pump 25a supplied to the second actuator 21, the load pressure of the second actuator 21 dominates the delivery pressure of the first hydraulic pump 25a, whereby the pump delivery pressure does not rise up to 220 bar and takes a value smaller than 220 bar, e.g., about 140 bar, corresponding to the input amount to the third flow control valve 12a. In other words, since the pressure downstream of the first flow control valve 11a is equal to the load pressure 200 bar of the first actuator 19 as mentioned above, the delivery pressure of the first hydraulic pump 25a is lower than the pressure downstream of the first flow control valve 11a and the hydraulic fluid from the first hydraulic pump 25a is not supplied to the first actuator 19.

Thus, although the third pressure control valve 15b associated with the second actuator 21 on the lower pressure side is forcibly driven in the valve-closing direction by the load pressure 200 bar of the first actuator 19, most of the hydraulic fluid from the first hydraulic pump 25a is supplied to the second actuator 21 and, therefore, the second actuator 21 can be driven satisfactorily. The hydraulic fluid from the second hydraulic pump 25b is distributed in accordance with the opening ratio of the second flow control valve 11b to the fourth flow control valve 12b, and the distributed flow rate is supplied to the first actuator 19 via the first directional control valve 7, thereby driving the first actuator 1.

The first and second delivery rate controllers 30a, 30b each have the servo valve 59 for input torque limiting control, as mentioned before. Therefore, if the delivery pressure of the first hydraulic pump 25a was also raised up to 220 bar like the delivery pressure of the second hydraulic pump 25b, the servo valve 59 would be operated to make control for reducing the tilting angle of the first hydraulic pump 25a, hence the pump delivery rate. In this embodiment, however, since the delivery pressure of the first hydraulic pump 25a rises up to about 140 bar at maximum, the associated servo valve 59 will not operate or is operated to a small extent, if so, allowing the first hydraulic pump 25a to maintain a sufficient delivery rate.

Figure 3:
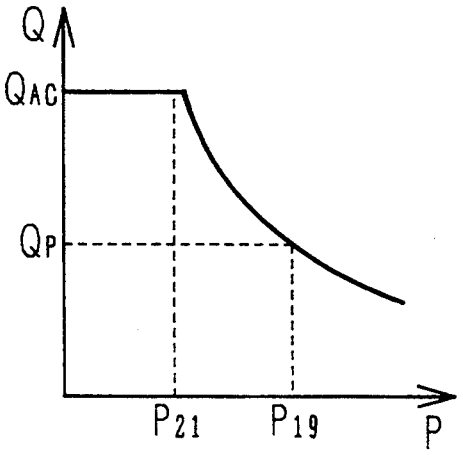
FIG. 3 is a graph showing pressure versus flow rate characteristics of a pump provided in the delivery rate control means shown in FIG. 2.

FIG. 3 shows pressure versus flow rate characteristics resulted when the servo valve 59 for input torque limiting control is operated. In the graph, the horizontal axis represents a pump delivery pressure P and the vertical axis represents a pump delivery rate Q. Assuming that the delivery pressure of the first hydraulic pump 25a is $P_{21}$ and the delivery pressure of the second hydraulic pump 25b is $P_{19}$, the delivery pressure $P_{21}$ is about 140 bar but the delivery pressure $P_{19}$is 200 bar, as mentioned above. The servo valve 59 will not operate at the delivery pressure $P_{21}$ of 140 bar, the first hydraulic pump 25a can maintain a large delivery rate $Q_{AC}$. On the other hand, the servo valve 59 is operated at the delivery pressure $P_{19}$of 220 bar and the delivery rate of the second hydraulic pump 25b is reduced down to $Q_p$.

Accordingly, the second actuator 21 producing the lower load pressure of 100 bar is supplied with the sum of the delivery rate $Q_{AC}$of the first hydraulic pump 25a and part of the delivery rate $Q_p$ of the second hydraulic pump 25b distributed depending on the opening of the fourth flow control valve 12b, while the first actuator 19 producing the higher load pressure of 200 bar is supplied with part of the delivery rate $Q_p$ of the second hydraulic pump 25b distributed depending on the opening of the second flow control valve 11b.

With this embodiment, since a reduction in the delivery rate of the first hydraulic pump 25a itself is suppressed, the hydraulic fluid is supplied to the second actuator 21 on the lower pressure side at such a larger flow rate as able to drive the second actuator 21 in a satisfactory manner.

Next, consider the case that the driving mode is shifted from the sole operation of the second actuator 21 to the combined operation of the first and second actuator 21. It is here assumed that the load pressure of the second actuator 21 is the same 100 bar as above during the sole operation.

During the sole operation of the second actuator 21, the load pressure 100 bar of the second actuator 21 is introduced to the pressure signal transmitting line 52 and further introduced to the first delivery rate controller 30a and the second delivery rate controller 30b via the lines 31a, 31b. The delivery pressures of the first and second hydraulic pumps 25a, 25b are each thereby controlled to become a constant pressure, e.g., 120 bar, higher a fixed value than 100 bar.

The load pressure of 100 bar introduced to the pressure signal transmitting line 52 is also applied to the drive sector of the third pressure control valve 15b, whereupon the third pressure control valve 15b is operated to make the pressure upstream of the third pressure control valve 15b, i.e., the pressure downstream of the fourth flow control valve 12b, equal to the load pressure 100 bar of the second actuator 21. The pressure downstream of the third flow control valve 12a associated with no pressure control valve is naturally equal to the load pressure 100 bar of the second actuator 21. Meanwhile, the pressures upstream of the third and fourth flow control valves 12a, 12b are equal to the delivery pressures of the first and second hydraulic pumps 25a, 25b, i.e., 120 bar. Accordingly the differential pressures across the third and fourth flow control valves 12a, 12b are equal to each other, i.e., 20 bar, so that the hydraulic fluids from the first and second hydraulic pumps 25a, 25b are supplied to the second actuator 21 via the second directional control valve 9 at respective flow rates depending on the openings of the third and fourth flow control valves 12a, 12b.

Under the above condition that the second actuator 21 is solely driven, when the control lever (not shown) associated with the first actuator 19 to shift the first directional control valve 7, the first flow control valve 11a and the second flow control valve 11b in an interlocked manner with an intention of shifting to the combined operation of the first actuator 19 and the second actuator 21, the load pressure 200 bar of the first actuator 19 is introduced to the pressure signal transmitting line 52, followed by being further applied to the first delivery rate controller 30*a* and the second delivery rate controller 30*b*, as well as to the drive sector of the first pressure control valve 13*a*, the drive sector of the second pressure control valve 13*b* and the drive sector of the third pressure control valve 15*b*. Accordingly, as explained before, the delivery rates of the first and second hydraulic pumps 25*a*, 25*b* are controlled so that the delivery pressures become 140 bar and 220 bar, respectively, and the pressures downstream of the flow control valves 11*a*, 11*b*, 12*b* are each controlled to become equal to the higher load pressure, thus enabling the combined operation of the first and second actuators 19, 21 to be carried out.

The load pressure acting on the drive sector of the third pressure control valve 15*b* has been 100 bar during the sole operation of the second actuator 21, but is increased up to 200 bar upon shift to the combined operation of the first and second actuators 19, 21, whereby the third pressure control valve 15*b* is abruptly restricted. At this time, the delivery pressure of the second hydraulic pump 25*a* connected to the fourth flow control valve 12*b* is controlled by the second delivery rate controller 30*b* to rise from 120 bar up to 220 bar, as explained before. However, there is a response delay in such control of the second delivery rate controller 30*b*. Thus, because of both the abrupt restriction of the second pressure control valve 15*b* and the response delay in control of the second delivery rate controller 30*b*, the flow rate of the hydraulic fluid supplied from the second hydraulic pump 25*b* to the second actuator 21 decreases transiently. On the other hand, since no pressure control valve is disposed downstream of the third flow control valve 12*a*, the hydraulic fluid from the first hydraulic pump 25*a* is supplied to the second actuator 21 without being restricted. Therefore, an abrupt reduction in the flow rate of the hydraulic fluid supplied to the second actuator 21 is prevented.

With this embodiment, accordingly, when the first actuator 19 of higher load pressure and the second actuator 21 of lower load pressure are driven simultaneously, the hydraulic fluid can be supplied to the second actuator 21 of lower load pressure at a sufficient flow rate, making it possible to increase efficiency of working appliances (not shown) operated through the actuators 19, 21, i.e., to realize improved efficiency of operation carried out by the working appliances.

Also, since the hydraulic fluid from the first hydraulic pump 25*a* is supplied to the second actuator 21 via the third flow control valve 12*a* and the second directional control valve 9 without passing no pressure control valve, the pressure loss caused by the presence of the pressure control valve can be suppressed and generation of heat can be held down, making it possible to improve heat balance in the circuit and prevent deterioration of the hydraulic fluid recirculating through the circuit due to rise of its temperature. Further, the energy loss in the first hydraulic pump 25*a* can be suppressed, which contributes to a reduction in the fuel cost of the prime mover 25*c*.

In addition, with this embodiment, upon shift from the sole operation of the second actuator 21 of lower load pressure to the combined operation of the first actuator 19 of higher load pressure and the second actuator 21 of lower load pressure, the flow rate of the hydraulic fluid supplied to the second actuator 21 of lower load pressure can be prevented from reducing transiently, which also contributes to an improvement in the working efficiency.

Second Embodiment

Figure 4:
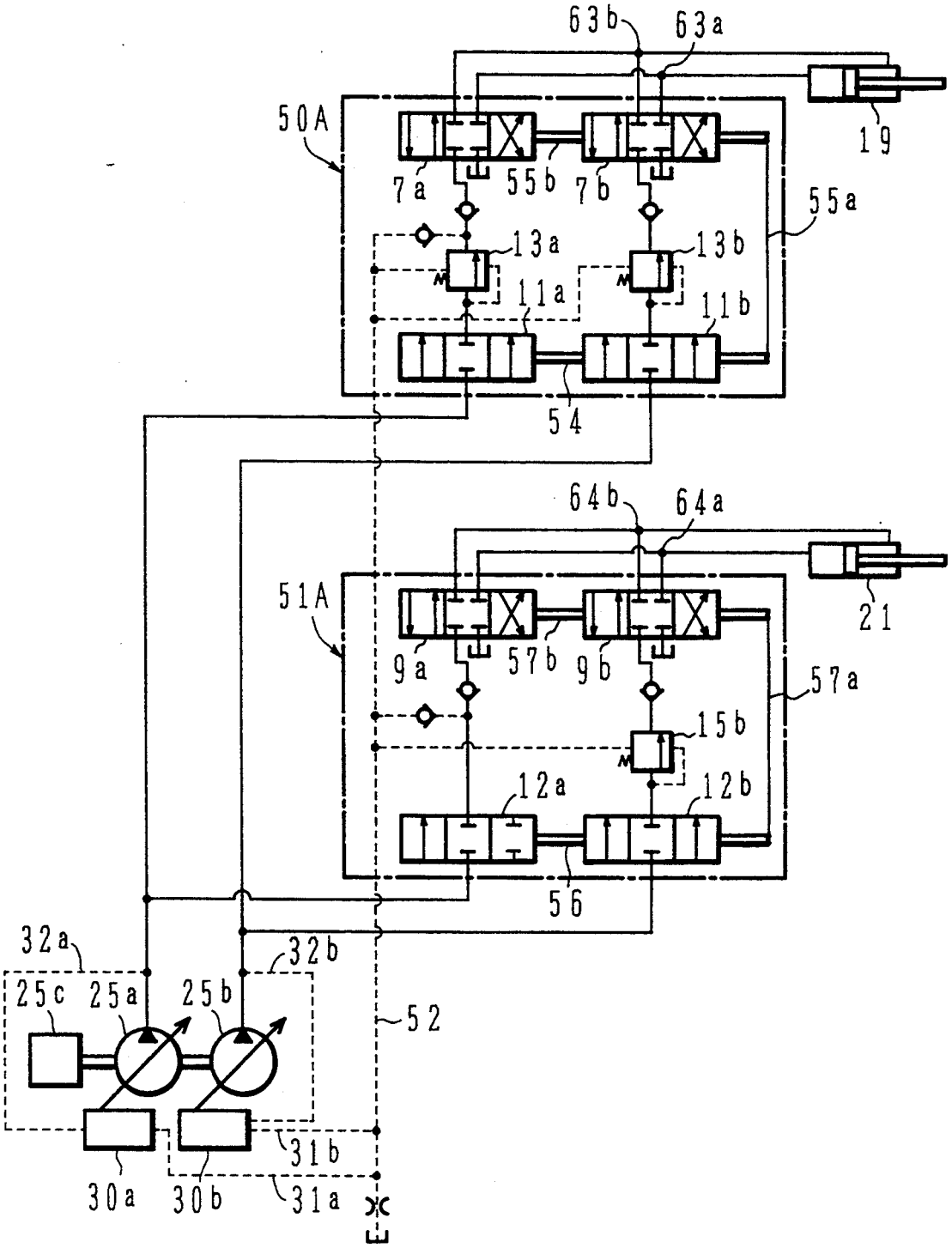
FIG. 4 is a circuit diagram showing the construction of a hydraulic drive system for a construction machine according to a second embodiment of the present invention.

A second embodiment of the present invention will be described below with reference to FIG. 4. In FIG. 4, identical members to those shown in FIG. 1 are denoted by the same reference numerals.

Referring to FIG. 4, a hydraulic drive system for construction machines of this embodiment has valve apparatus 50A, 51A which are different from the valve apparatus 50, 51 in the first embodiment.

More specifically, the valve apparatus 50A includes first and second two directional control valves 7*a*, 7*b* coupled to each other via a rod 55*b*, as directional control valves for controlling the direction in which the first actuator 19 is to be driven. The first directional control valve 7*a* is disposed downstream of the first pressure control valve 13*a*, and the second directional control valve 7*a*, 7*b* is disposed downstream of the second pressure control valve 13*b*. The first and second directional control valves 7*a*, 7*b* are coupled to the first and second flow control valves 11*a*, 11*b* via a link 55*a*.

Likewise, the valve apparatus 51A includes third and fourth two directional control valves 9*a*, 9*b* coupled to each other via a rod 57*b*, as directional control valves for controlling the direction in which the second actuator 21 is to be driven. The third directional control valve 9*a* is disposed downstream of the third flow control valve 12*a* with no pressure control valve therebetween, and the fourth directional control valve 9*b* is disposed downstream of the third pressure control valve 15*b*. The third and fourth directional control valves 9*a*, 9*b* are coupled to the third and fourth flow control valves 12*a*, 12*b* via a link 57*a*.

Thus, the first hydraulic pump 25*a* is connected to the first actuator 19 via the first flow control valve 11*a*, the first pressure control valve 13*a* and the first directional control valve 7*a*, while the second hydraulic pump 25*b* is connected to the first actuator 19 via the second flow control valve 11*b*, the second pressure control valve 13*b* and the second directional control valve 7*b*. Further, the lines downstream of the first and second flow control valves 11*a*, 11*b* are connected to each Other such that the hydraulic fluid delivered from the first hydraulic pump 25*a* and the hydraulic fluid delivered from the second hydraulic pump 25*b* join together at respective junctions 63*a*, 63*b* located between the first and second directional control valves 7*a*, 7*b* and the first actuator 19.

The first hydraulic pump 25*a* is also connected to the second actuator 21 via the third flow control valve 12*a* and the third directional control valve 9*a* in parallel to the first actuator 19 with no pressure control valve downstream of the third flow control valve 12*a*. The second hydraulic pump 25*b* is also connected to the second actuator 21 via the fourth flow control valve 12*b*, the third pressure control valve 15*b* and the fourth directional control valve 9*b* in parallel to the first actuator 19. Further, the lines downstream of the third and fourth flow control valves 12*a*, 12*b* are connected to each other such that the hydraulic fluid delivered from the first hydraulic pump 25*a* and the hydraulic fluid delivered from the second hydraulic pump 25*b* join together at respective junctions 64*a*, 64*b* located between the third and fourth directional control valves 9a, 9b and the second actuator 21.

The remaining construction is the same as that of the above-explained first embodiment.

With the second embodiment thus constructed, although the junctions 63a, 63b and 64a, 64b of the hydraulic fluids delivered from the first and second hydraulic pumps 25a, 25b are located differently from the first embodiment, because of no pressure control valve provided between the third flow control valve 12a communicating with the first hydraulic pump 25a and the third directional control valve 9a, most of the hydraulic fluid from the first hydraulic pump 25a is supplied to the second actuator 21 via the third flow control valve 12a and the third directional control valve 9a during the combined operation of the first actuator 19 of higher load pressure and the second actuator 21 of lower load pressure. Also, the delivery pressure of the first hydraulic pump 25a does not become so high and the associated servo valve 59 for input torque limiting control is not appreciably operated, enabling the first hydraulic pump 25a to maintain a sufficient delivery rate. Consequently, the hydraulic fluid can be supplied to the second actuator 21 of lower load pressure at a sufficient flow rate, with the result of similar advantages to those in the first embodiment.

In addition, upon shift from the sole operation of the second actuator 21 of lower load pressure to the combined operation of the first actuator 19 of higher load pressure and the second actuator 21 of lower load pressure, since no pressure control valve is provided between the third flow control valve 12a communicating with the first hydraulic pump 25a and the third directional control valve 9a, the flow rate of the hydraulic fluid supplied to the second actuator 21 of lower load pressure can be prevented from reducing transiently, which also provides a similar advantage to that in the first embodiment.

Third Embodiment

A third embodiment of the present invention will be described below with reference to FIGS. 5 to 8. In these figures, identical members to those shown in FIG. 1 are denoted by the same reference numerals. In this third embodiment, the present invention is applied to a hydraulic drive system for hydraulic excavators. Note that FIGS. 5 and 6 show, when combined with each other, the entire construction of the hydraulic drive system of this embodiment.

Figures 5, 6:
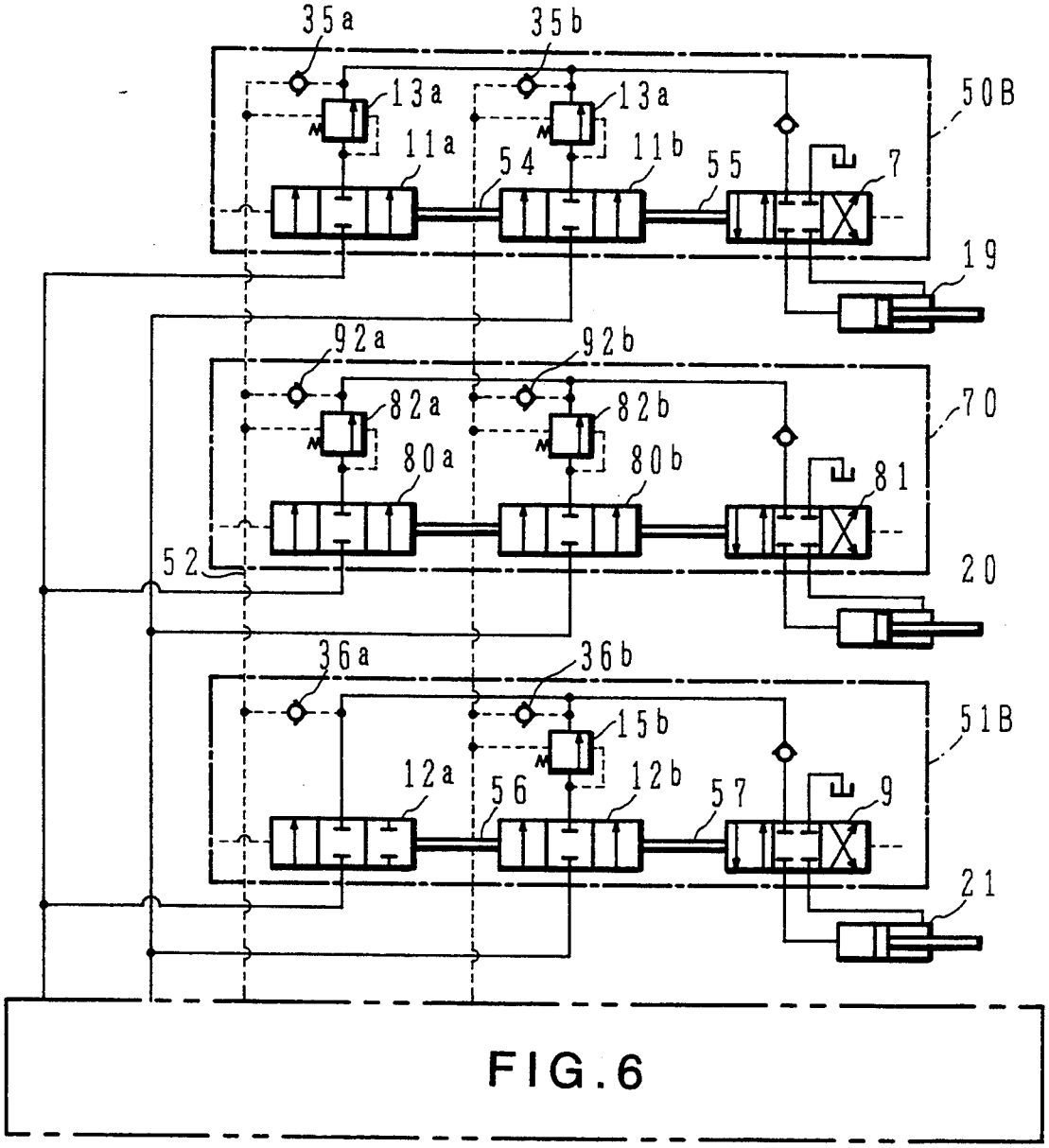
FIG. 5 is a circuit diagram showing part of the construction of a hydraulic drive system for a construction machine according to a third embodiment of the present invention.
FIG. 6 is a circuit diagram showing part of the construction of the hydraulic drive system according to the third embodiment of the present invention, showing the entire hydraulic drive system when combined with FIG. 5.
Figure 6:
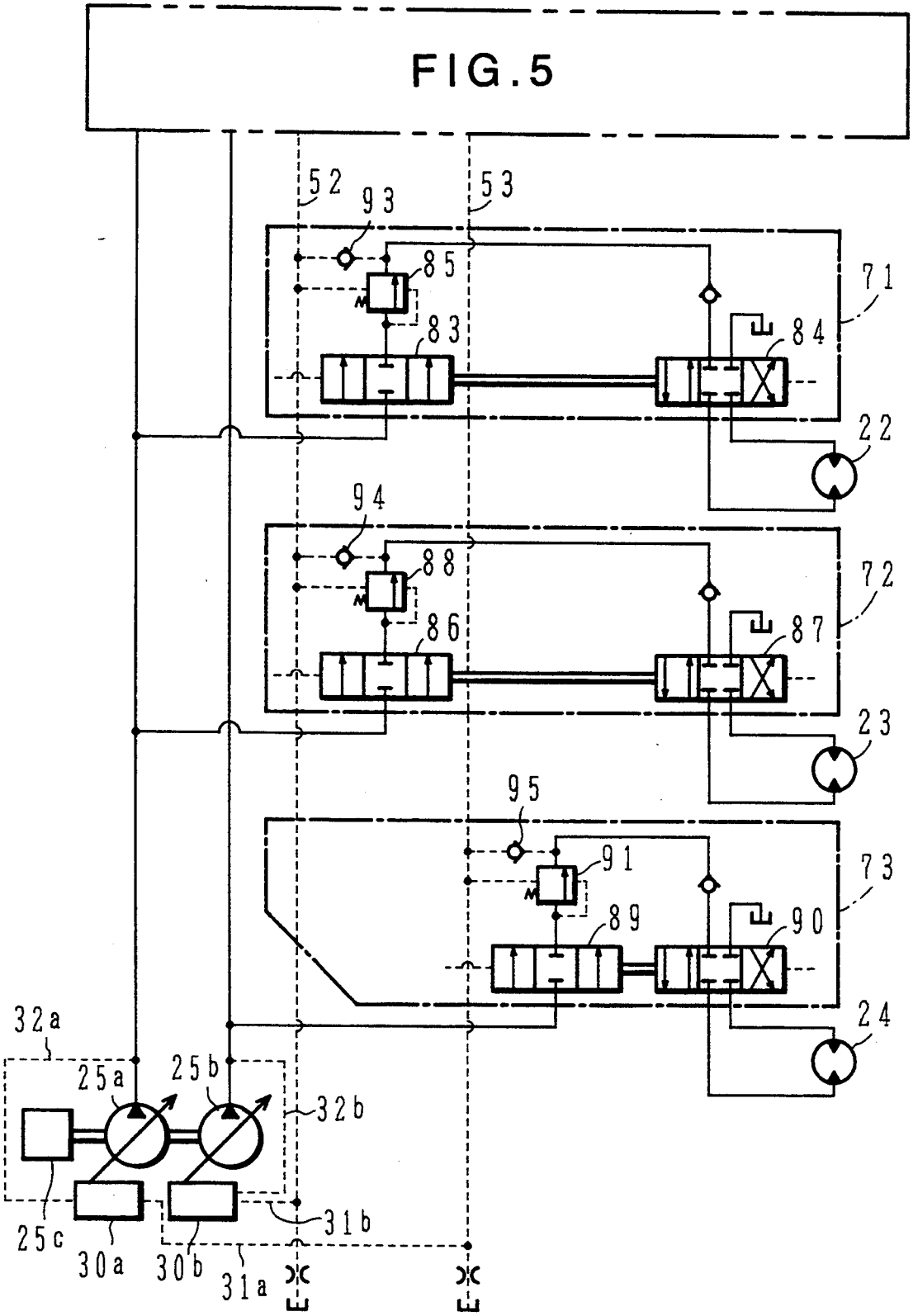

Referring to FIGS. 5 and 6, the hydraulic drive system for hydraulic excavators of this embodiment comprises a plurality of actuators 19, 20, 21, 22, 23, 24 which are associated with a bucket cylinder, an arm cylinder, a boom cylinder, a swing motor, a left travel motor and a right travel motor, respectively. The hydraulic drive system of this embodiment also has a plurality of valve apparatus SOB, 51B, 70, 72, 73 for controlling driving of the plural actuators 19, 20, 21, 22, 23, 24, respectively. The valve apparatus 50B, 51B are essentially of the same constructions as the valve apparatus 50, 51 in the first embodiment.

The valve apparatus 70 is constructed similarly to the valve apparatus 50B. More specifically, the valve apparatus 70 includes flow control valves 80a, 80b and a directional control valve 81 coupled to each other via a rod, and pressure control valves 82a, 82b. The flow control valves 80a, 80b are respectively connected to the first and second hydraulic pumps 25a, 25b.

The valve apparatus 71 includes only a flow control valve 83 connected to the first hydraulic pump 25a, a directional control valve 84 and a pressure control valve 85. Likewise, the valve apparatus 72 includes only a flow control valve 86 connected to the first hydraulic pump 25a, a directional control valve 87 and a pressure control valve 88. Further, the valve apparatus 73 includes only a flow control valve 89 connected to the second hydraulic pump 25b, a directional control valve 90 and a pressure control valve 91.

The hydraulic drive system of this embodiment also comprises two pressure signal transmitting lines 52, 53. The first pressure signal transmitting line 52 is connected to the lines downstream of the pressure control valves 13a, 82a, 85, 88 and the line downstream of the flow control valve 12a via check valves 35a, 36a, 92a, 93, 94, respectively. Therefore, the highest one of load pressures of the plural actuators 19, 20, 21, 22, 23, i.e., the maximum load pressure among them, is taken out to the pressure signal transmitting line 52 via the check valves 35a, 36a, 92a, 93, 94. The second pressure signal transmitting line 53 connected to the lines downstream of the pressure control valves 13b, 15b, 82b, 91 via check valves 35b, 36b, 92b, 95, respectively. Therefore, the highest one of load pressures of the plural actuators 19, 20, 21, 24, i.e., the maximum load pressure among them, is taken out to the pressure signal transmitting line 53 via the check valves 35b, 36b, 92b, 95.

Respective drive sectors of the pressure control valves 13a, 82a, 85, 88 are connected to the first pressure signal transmitting line 52, and respective drive sectors of the pressure control valves 13b, 15b, 82b, 91 are connected to the second pressure signal transmitting line 53.

The first delivery rate controller 30a and the second delivery rate controller 30b are respectively connected to the first pressure signal transmitting line 52 and the second pressure signal transmitting line 53 via the lines 31a, 31b, respectively.

Figure 7:
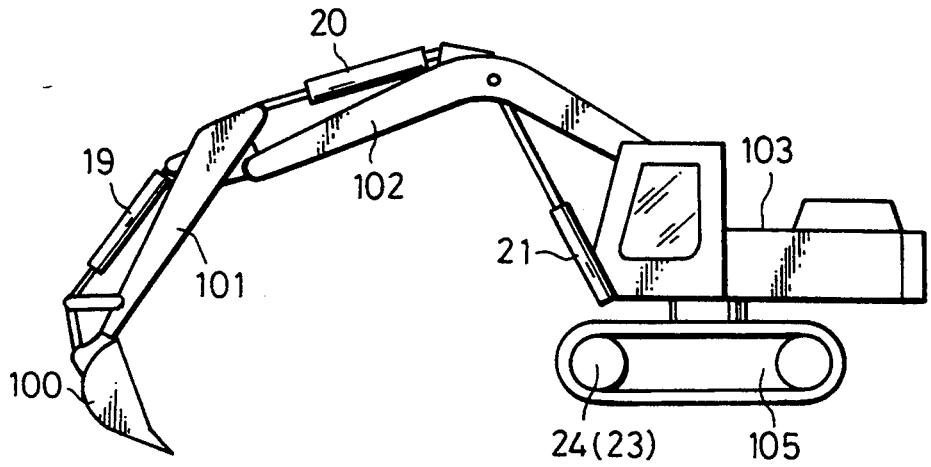
FIG. 7 is a side view of a hydraulic excavator mounting the hydraulic drive system shown in FIGS. 5 and 6.
Figure 8:
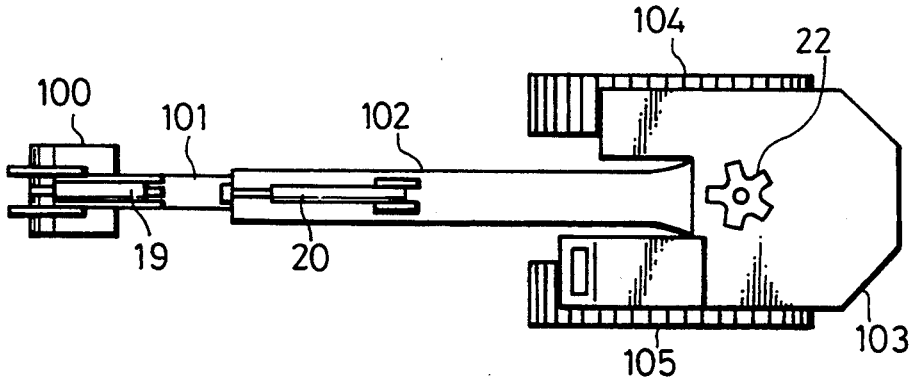
FIG. 8 is a top plan view of the hydraulic excavator mounting the hydraulic drive system shown in FIGS. 5 and 6.

The construction of a hydraulic excavator mounting the hydraulic drive system of this embodiment thereon will now be described with reference to FIGS. 7 and 8. The bucket cylinder 19, the arm cylinder 20 and the boom cylinder 21 respectively drive a bucket 100, an arm 101 and a boom 102. The swing motor 22 drives a swing 103, and the right and left travel motors 23, 24 drive crawler belts 104, 105.

In the third embodiment thus constructed, when the boom 102 is driven by the actuator 21 (boom cylinder) while relieving the actuator 19 (bucket cylinder) during the combined operation of the boom 102 and the bucket 100, for example, the bucket cylinder 19 is on the higher pressure side and the boom cylinder 21 is on the lower pressure side. But the load pressure of the bucket cylinder 19 on the higher pressure side is introduced to both the first and second pressure signal transmitting lines 52, 53, causing the first and second delivery rate controllers 30a, 30b and the pressure control valves 13a, 13b, 15b to operate in a like manner to the case of the first embodiment. Also, the valve apparatus 51B includes no pressure control valve between the flow control valve 12a communicating with the first hydraulic pump 25a and the directional control valve 9. Therefore, most of the hydraulic fluid from the first hydraulic pump 25a is supplied to the boom cylinder 21 via the flow control valve 12a and the directional control valve 9. Additionally, the delivery pressure of the first hydraulic pump 25a does not become so high and the associated servo valve 59 for input torque limiting control is not appreciably operated, enabling the first hydraulic pump 25*a* to maintain a sufficient delivery rate. Consequently, the hydraulic fluid can be supplied to the boom cylinder 21 of lower load pressure at a sufficient flow rate, with the result of improved working efficiency similarly to the first embodiment, In addition, upon shift from the sole operation of the boom cylinder 21 driven at a lower load pressure to the combined operation of both the cylinders 19, 21 in which the bucket cylinder 19 is driven at a higher load pressure, since no pressure control valve is provided in the valve apparatus 51B between the flow control valve 12*a* communicating with the first hydraulic pump 25*a* and the directional control valve 9*a* , the flow rate of the hydraulic fluid supplied to the boom cylinder 21 can be prevented from reducing transiently, which can also improve the working efficiency as with the first embodiment.

Moreover, in this embodiment, since the first and second pressure signal transmitting lines 52, 53 are separately provided and the valve apparatus 71, 72, 73 are connected to only one of those pressure signal transmitting lines, it is possible to introduce different load pressures to the first and second delivery rate controllers 30*a*, 30*b* and the associated pressure control valves via the first and second pressure signal transmitting lines 52, 53, thereby driving them.

Consider the combined operation of travel and bucket, by way of example, in which the actuator 19 (bucket cylinder) is operated for digging earth and sand while traveling in a condition that the crawler belt 104 driven by the actuator 23 (right travel motor) travels on the flat ground surface and the crawler belt 105 driven by the actuator 24 (left travel motor) travels on the sloped ground surface, i.e., in a slightly inclined condition of the excavator. During that combined operation, the load pressure of the left travel motor 24 is higher than the load pressure of the right travel motor 23. It is also supposed that the load pressure of the bucket cylinder 19 is lowest. In such a case, introduced to the first pressure signal transmitting line 52 is the highest one among the load pressures of the actuators associated with the valve apparatus connected to the first pressure signal transmitting line 52, i.e., the load pressure of the right travel motor 23, and introduced to the second pressure signal transmitting line 53 is the highest one among the load pressures of the actuators associated with the valve apparatus connected to the second pressure signal transmitting line 53, i.e., the load pressure of the left travel motor 24. Therefore, the load pressure of the right travel motor 23 lower than the load pressure of the left travel motor 24 is introduced to the first delivery rate controller 30*a* which is thus driven in accordance with the load pressure of the right travel motor 23, while the load pressure of the left travel motor 24 is introduced to the second delivery rate controller 30*b* which is thus driven in accordance with the load pressure of the left travel motor 24. Further, the above different load pressures are also introduced to the drive sectors of the pressure control valves 13*a*, 88 and the pressure control valves 13*b*, 91 for driving these pressure control valves at such different pressures.

As a result, the delivery pressure of the first hydraulic pump 25*a* just requires a relatively low level slightly higher than the load pressure of the right travel motor 23 which is lower than the load pressure of the left travel motor 24. This improves efficiency of the first hydraulic pump 25*a* and enables a reduction in the fuel cost of the prime mover 25*c* for driving the first hydraulic pump 25*a* Also, as explained above with reference to FIG. 3 in the first embodiment, the lower pump delivery pressure leads to a smaller reduction in the pump delivery rate due to operation of the servo valve 59 for input torque limiting control, whereby the hydraulic fluid is supplied to the boom cylinder 19 at a larger flow rate than the case that both the delivery pressures of the first and second hydraulic pumps 25*a*, 25*b* would be increased. It is thus possible to raise the operating speed of the boom cylinder 19 and improve the working efficiency.

Additionally, since the pressure control valve 13*a* for controlling the pressure downstream of the flow control valve 11*a*, which controls the flow rate of the hydraulic fluid supplied to the boom cylinder 19, is driven in accordance with the load pressure of the right travel motor 23, the pressure control valve 13*a* is less restricted than the case that it would be driven in accordance with the load pressure of the left travel motor 24. Therefore, the pressure loss in the pressure control valve 13*a* can be suppressed and generation of heat can be held down, making it possible to improve heat balance in the circuit and prevent deterioration of the hydraulic fluid recirculating through the circuit due to rise of its temperature.

Fourth Embodiment

Figure 9:
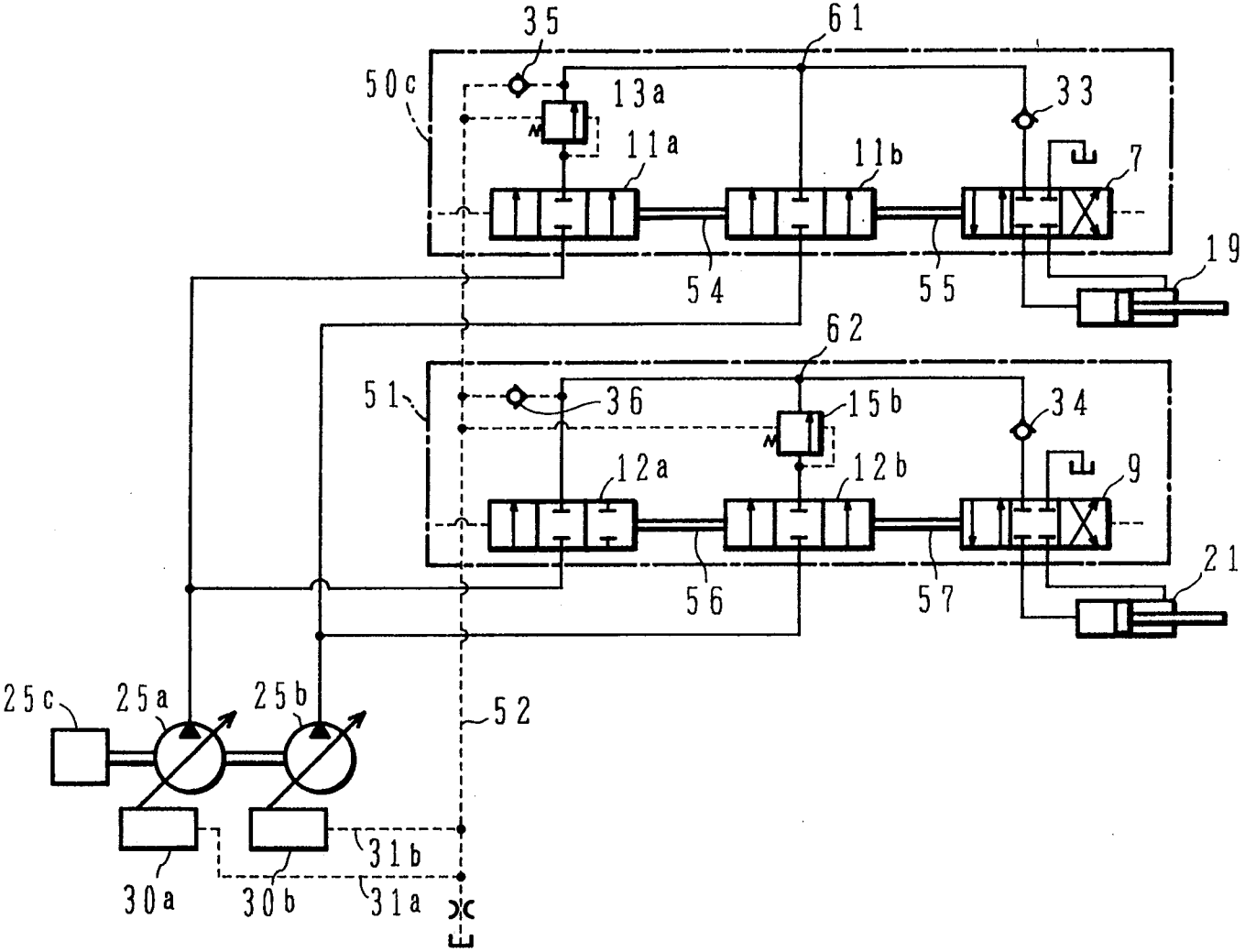
FIG. 9 is a circuit diagram showing the construction of a hydraulic drive system for a construction machine according to a fourth embodiment of the present invention.

A fourth embodiment of the present invention will be described below with reference to FIG. 9. In FIG. 9, identical members to those shown in FIG. 1 are denoted by the same reference numerals.

Referring to FIG. 9, a hydraulic drive system for construction machines of this embodiment has valve apparatus 50C, 51. In the valve apparatus 50C, no pressure control valve is provided between the second flow control valve 11*b* communicating with the second hydraulic pump 25*b* and the first directional control valve 7. Stated otherwise, the second hydraulic pump 25*b* is connected to the first actuator 19 via the second flow control valve 11*b* and the first directional control valve 7 without providing any pressure control valve downstream of the second flow control valve 11*b*.

The first actuator 19 and the second actuator 21 are such actuators as producing load pressures changeable in mutual relation of magnitude depending on change in the kind of work to be carried out.

The remaining construction is the same as that of the above-explained first embodiment.

With the fourth embodiment thus constructed, the hydraulic drive system operates essentially in the same manner as the first embodiment when the load pressure of the first actuator 19 is higher than the load pressure of the second actuator 21.

More specifically, assuming that the load pressure of the first actuator 19 and the load pressure of the second actuator 21 are respectively 200 bar and 100 bar under a driven condition, when the first and second actuators 19, 21 are driven simultaneously, the load pressure of 200 bar is introduced to the first delivery rate controller 30*a* and the second delivery rate controller 30*b* via the pressure signal transmitting line 52. The delivery pressures of the first and second hydraulic pumps 25*a*, 25*b* are each thereby controlled to become a constant pressure, e.g., 220 bar, higher a fixed value than 200 bar. As described before in connection with the first embodiment, however, because no pressure control valve is provided between the third flow control valve 12*a* communicating with the first hydraulic pump 25*a* and the second directional control valve 9, the delivery pressure of the first hydraulic pump 25*a* does not rise up to 220 bar and takes a value, e.g., about 140 bar, corresponding to an input amount to the third flow control valve 12*a*, when the input amount is large.

The load pressure of 200 bar is also introduced to the drive sector of the first pressure control valve 13a and the drive sector of the third pressure control valve 15*b* via the pressure signal transmitting line 52, whereby the pressures upstream of the first pressure control valve 13*a* and the third pressure control valve 15*b*, i.e., the pressures downstream of the first flow control valve 11*a* and the fourth flow control valve 12*b*, become equal to the load pressure 200 bar of the first actuator 19. Although no pressure control valve is provided downstream of the second flow control valve 11*b*, the pressure downstream of the second flow control valve 11*b* is naturally equal to the load pressure 200 bar of the first actuator 19. Meanwhile, the pressures upstream of the second flow control valve 11*b* and the fourth flow control valve 12*b* are both equal to the delivery pressure of the second hydraulic pump 25*b*, i.e., 220 bar. Accordingly, the differential pressures across the second flow control valve 11*b* and the fourth flow control valve 12*b* are equal to each other so that the hydraulic fluid from the second hydraulic pump 25*b* is distributed in accordance with the opening ratio of the second flow control valve 11*b* to the fourth flow control valve 12*b* and then supplied to the first actuator 19 via the first directional control valve 7 and the second actuator 21 via the second directional control valve 9, respectively.

On the other hand, because no pressure control valve is provided between the third flow control valve 12*a* communicating with the first hydraulic pump 25*a* and the second directional control valve 9, most of the hydraulic fluid from the first hydraulic pump 25*a* is supplied to the second actuator 21 via the third flow control valve 12*a* and the second directional control valve 9 when the input amount to the third flow control valve 12*a* is large.

Further, since the delivery pressure of the first hydraulic pump 25*a* rises up to about 140 bar at maximum, the servo valve 59 (see FIG. 2) for input torque limiting control incorporated in the first delivery rate controller 30*a* will not operate or is operated to a small extent, if so, allowing the first hydraulic pump 25*a* to maintain a sufficient delivery rate. Thus, the hydraulic fluid can be supplied to the second actuator 21 of lower load pressure at a sufficient flow rate.

Consequently, there can be obtained similar advantages to those in the first embodiment, such as an improvement in working efficiency during the combined operation.

Even when the load pressures of the first and second actuators 19, 21 are reversed in their magnitudes during work under the above combined operation such that the load pressure of the second actuator 21 becomes higher than the load pressure of the first actuator 19, the hydraulic fluid can be supplied to the first actuator 19 on the lower pressure side at a sufficient flow rate in a like manner to the above case.

More specifically, assuming that the load pressure of the first actuator 19 and the load pressure of the second actuator 21 are respectively 100 bar and 200 bar after the magnitude of load pressure has reversed between the first and second actuators 19, 21, the load pressure of 200 bar is introduced to the first delivery rate controller 30*a* and the second delivery rate controller 30*b* via the pressure signal transmitting line 52. The delivery pressures of the first and second hydraulic pumps 25*a*, 25*b* are each thereby controlled to become a constant pressure, e.g., 220 bar, higher a fixed value than 200 bar. In this case, too, because no pressure control valve is provided between the second flow control valve 11*b* communicating with the second hydraulic pump 25*b* and the first directional control valve 7, the delivery pressure of the second hydraulic pump 25*b* does not rise up to 220 bar and takes a value, e.g., about 140 bar, corresponding to an input amount to the second flow control valve 11*b*, when the input amount is large.

The load pressure of 200 bar is also introduced to the drive sector of the first pressure control valve 13*a* and the drive sector of the third pressure control valve 15*b* via the pressure signal transmitting line 52, whereby the pressures upstream of the first pressure control valve 13*a* and the third pressure control valve 15*b*, i.e., the pressures downstream of the first flow control valve 11a and the fourth flow control valve 12*b*, become equal to the load pressure 200 bar of the first actuator 19. Although no pressure control valve is provided downstream of the third flow control valve 12*a*, the pressure downstream of the third flow control valve 12*a* is naturally equal to the load pressure 200 bar of the second actuator 21. Meanwhile, the pressures upstream of the first flow control valve 11a and the third flow control valve 12*a* are both equal to the delivery pressure of the first hydraulic pump 25*a*, i.e., 220 bar. Accordingly, the differential pressures across the first flow control valve 11*a* and the third flow control valve 12*a* are equal to each other so that the hydraulic fluid from the first hydraulic pump 25*a* is distributed in accordance with the opening ratio of the first flow control valve 11*a* to the third flow control valve 12*a* and then supplied to the first actuator 19 via the first directional control valve 7 and the second actuator 21 via the second directional control valve 9, respectively.

On the other hand, because no pressure control valve is provided between the second flow control valve 11*b* communicating with the second hydraulic pump 25*b* and the first directional control valve 7, most of the hydraulic fluid from the second hydraulic pump 25*b* is supplied to the first actuator 19 via the second flow control valve 11*b* and the first directional control valve 7 when the input amount to the second flow control valve 11*b* is large.

Further, since the delivery pressure of the second hydraulic pump 25*b* rises up to about 140 bar at maximum, the servo valve 59 (see FIG. 2) for input torque limiting control incorporated in the second delivery rate controller 30*b* will not operate or is operated to a small extent, if so, allowing the second hydraulic pump 25*b* to maintain a sufficient delivery rate.

Thus, even when the load pressures of the first and second actuators 19, 21 are reversed in their magnitudes, the hydraulic fluid can be supplied to the first actuator 19 of lower load pressure at a sufficient flow rate, making it possible to increase efficiency of working appliances (not shown) operated through the actuators 19, 21, i.e., to realize improved efficiency of operation carried out by the working appliances.

Also, since the hydraulic fluid from the second hydraulic pump 25*b* is supplied to the first actuator 19 without passing no pressure control valve, the pressure loss caused by the presence of the pressure control valve can be suppressed and generation of heat can be held down, thereby improving heat balance in the circuit. Further, the energy loss in the second hydraulic pump 25b can be suppressed, which contributes to a reduction in the fuel cost of the prime mover 25c.

In addition, upon shift from the sole operation of the second actuator 21 to the combined operation of the first and second actuators 19, 21 when the second actuator 21 is an actuator on the lower load side, the flow rate of the hydraulic fluid supplied to the second actuator 21 of lower load pressure can be prevented from reducing transiently and the operating speed of the second actuator 21 can be prevented from lowering, because of no pressure control valve being provided between the third flow control valve 12a communicating with the first hydraulic pump 25a and the second directional control valve 9.

Also, upon shift from the sole operation of the first actuator 19 to the combined operation of the first and second actuators 19, 21 when the first actuator 19 is an actuator on the lower load side, the flow rate of the hydraulic fluid supplied to the first actuator 19 of lower load pressure can be prevented from reducing transiently and the operating speed of the first actuator 19 can be prevented from lowering, because of no pressure control valve being provided between the second flow control valve 11b communicating with the second hydraulic pump 25b and the first directional control valve 7.

Consequently, this embodiment can provide similar advantages to those in the first embodiment and, even when the load pressures of the first and second actuators 19, 21 are reversed in their magnitudes, can also provide those similar advantages during the combined operation and upon shift from the sole operation of an actuator of lower load pressure to the combined operation.

Other Embodiments

Figure 10:
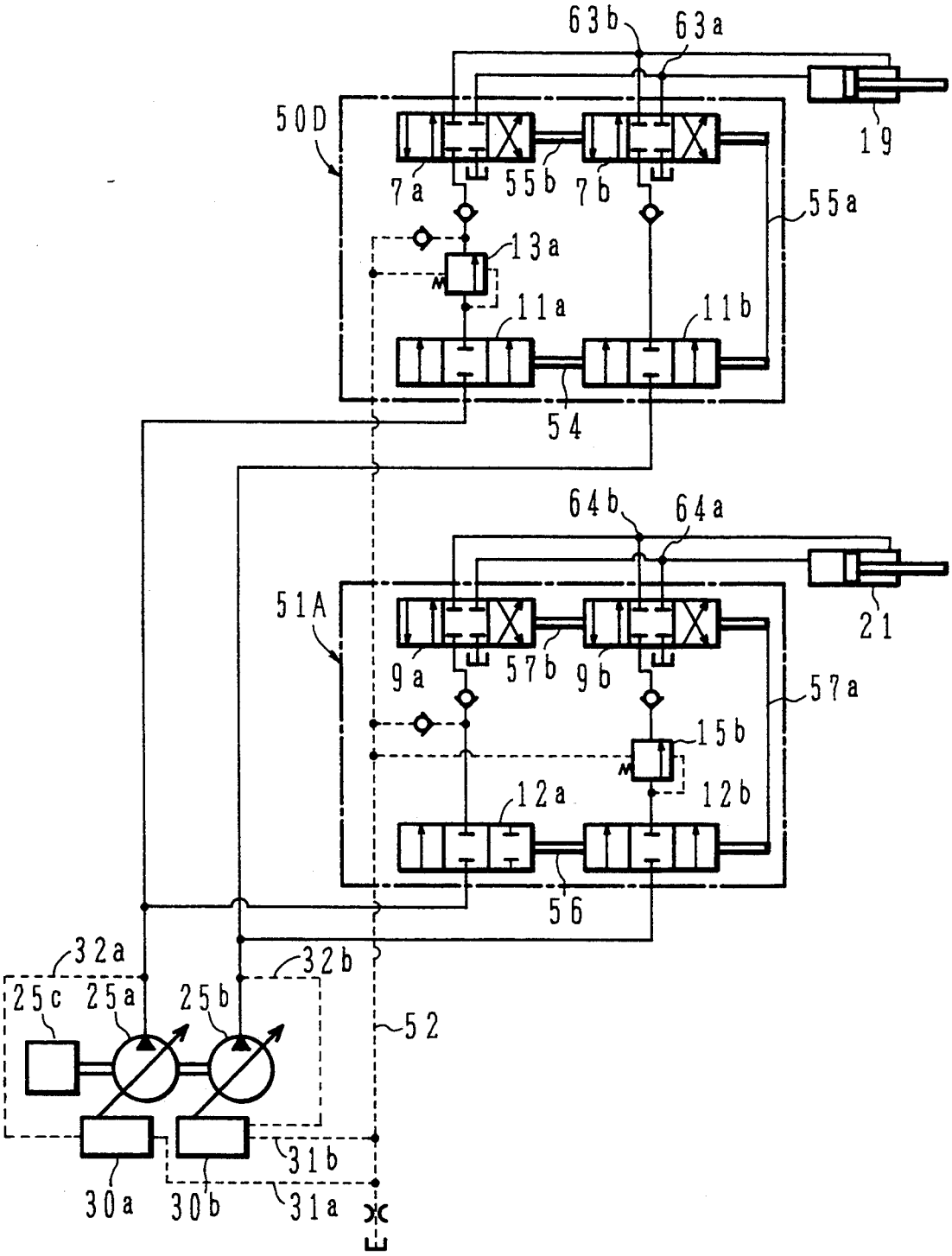
FIG. 10 is a circuit diagram showing the construction of a hydraulic drive system for a construction machine according to a fifth embodiment of the present invention.
Figures 11, 12:
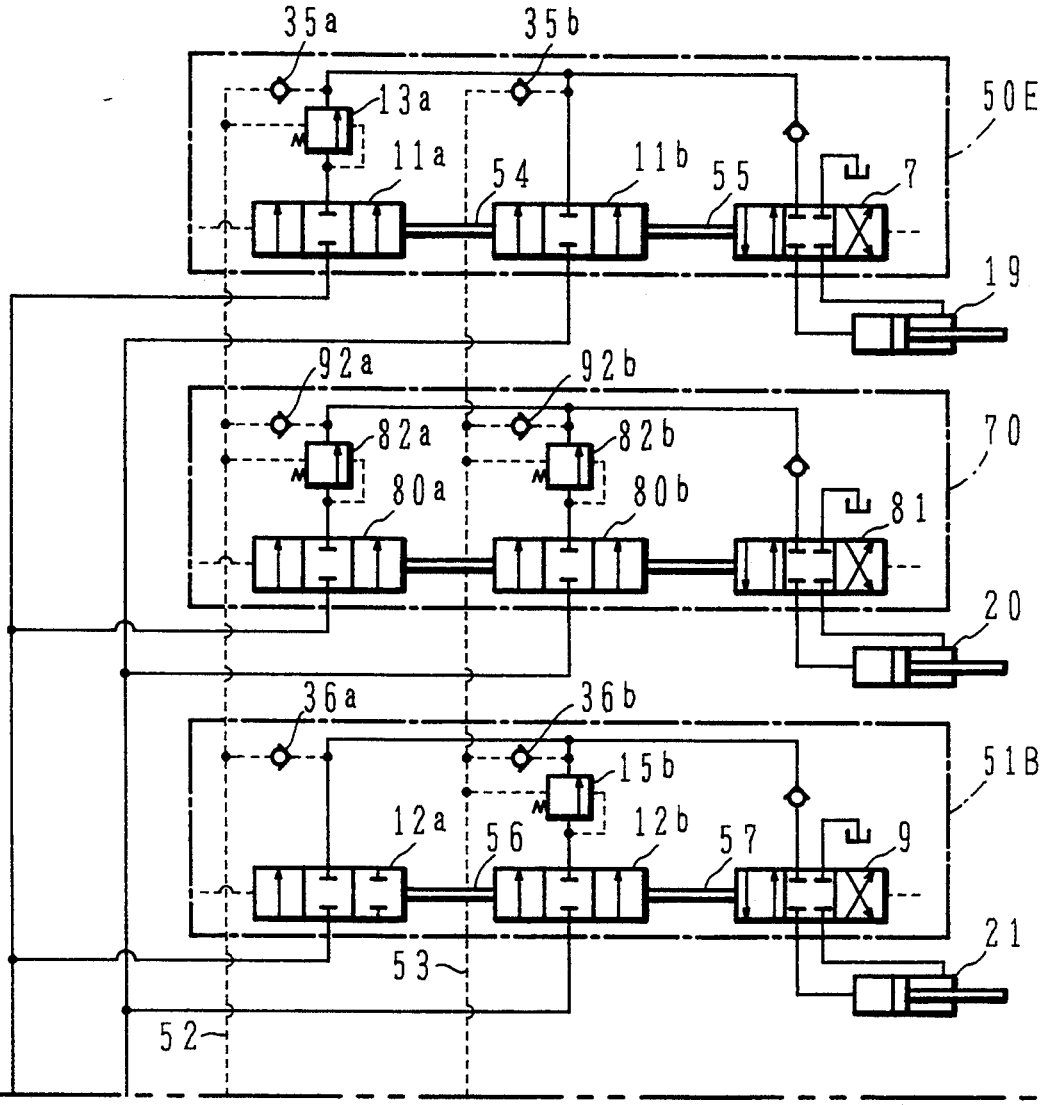
FIG. 11 is a circuit diagram showing part of the construction of a hydraulic drive system for a construction machine according to a sixth embodiment of the present invention.
FIG. 12 is a circuit diagram showing part of the construction of the hydraulic drive system according to the sixth embodiment of the present invention, showing the entire hydraulic drive system when combined with FIG. 5.
Figures 11, 12:
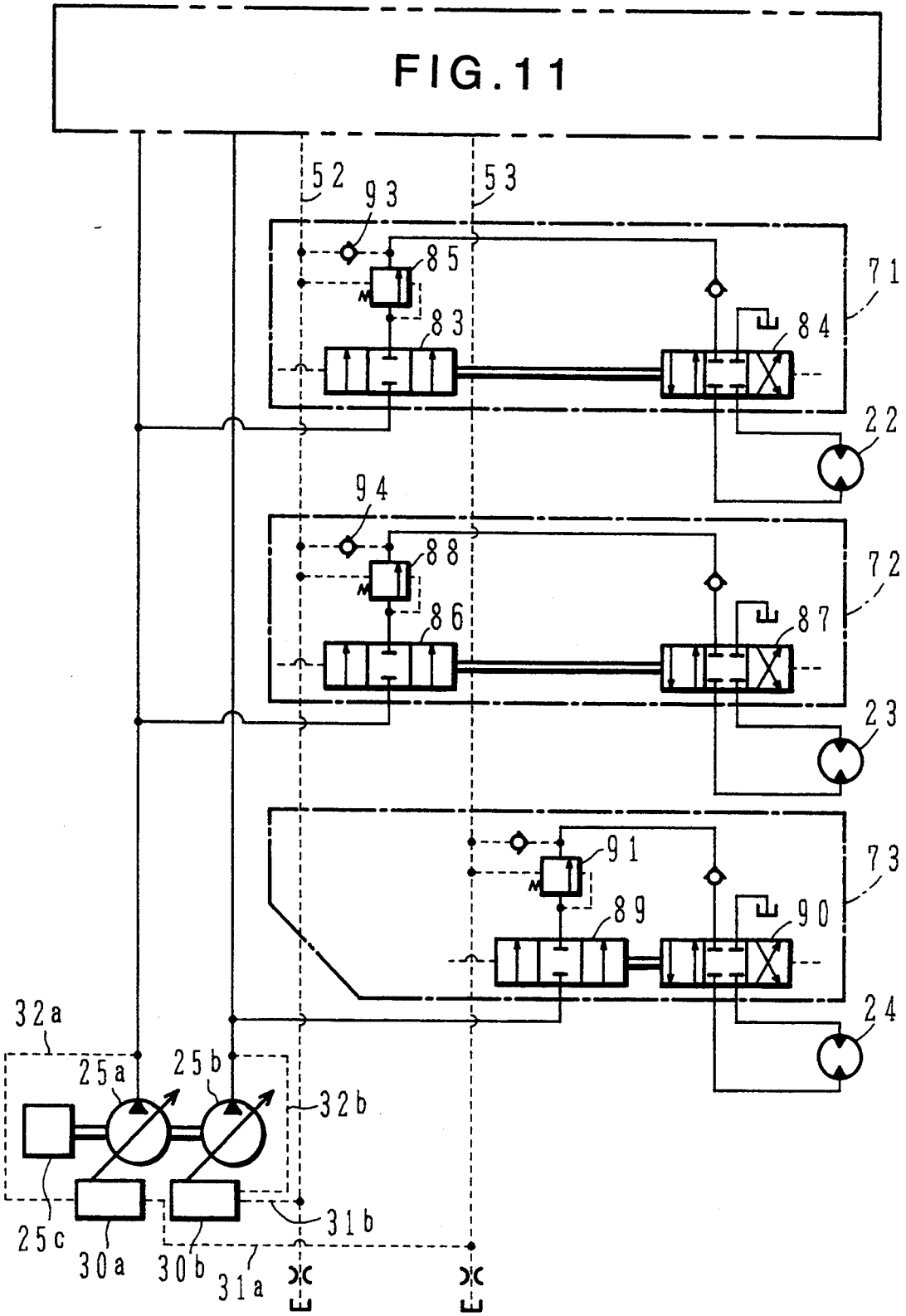

A fifth embodiment and a sixth embodiment of the present invention will be described below with reference to FIG. 10 and FIGS. 11 and 12, respectively. In FIG. 10, identical members to those shown in FIGS. 1 and 4 are denoted by the same reference numerals. In FIGS. 11 and 12, identical members to those shown in FIGS. 1, 5 and 6 are denoted by the same reference numerals.

In the fifth embodiment of the present invention shown in FIG. 10, the conception of the fourth embodiment shown in FIG. 9 is applied to the second embodiment shown in FIG. 4. In a valve apparatus 50D associated with the first actuator 19, no pressure control valve is provided between the second flow control valve 11b communicating with the second hydraulic pump 25b and the second directional control valve 7b as with the fourth embodiment. Stated otherwise, the second hydraulic pump 25b is connected to the first actuator 19 via the second flow control valve 11b and the second directional control valve 7b without providing any pressure control valve downstream of the second flow control valve 11b. The remaining construction is the same as that of the second embodiment.

With this fifth embodiment, even when the load pressures of the first and second actuators 19, 21 are reversed in their magnitudes, there can be provided similar advantages to those in the second advantages during the combined operation and upon shift from the sole operation of an actuator of lower load pressure to the combined operation.

In the sixth embodiment of the present invention shown in FIGS. 11 and 12, the conception of the fourth embodiment is applied to the third embodiment shown in FIGS. 5 and 6. In a valve apparatus 50E associated with the actuator 19 as the boom cylinder, no pressure control valve is provided between the second flow control valve 11b communicating with the second hydraulic pump 25b and the directional control valve 7 as with the fourth embodiment. Stated otherwise, the second hydraulic pump 25b is connected to the first actuator 19 via the second flow control valve 11b and the directional control valve 7 without providing any pressure control valve downstream of the second flow control valve 11b. The remaining construction is the same as that of the third embodiment.

With this sixth embodiment, even when the load pressures of the bucket cylinder 19 and the boom cylinder 21 are reversed in their magnitudes, there can be provided similar advantages to those in the third advantages during the combined operation and upon shift from the sole operation of an actuator of lower load pressure to the combined operation.

In the above embodiments, pump control means has been described as the delivery rate controller 30a or 30b for controlling the pump delivery rate so that the pump delivery pressure is held higher a fixed value than the load pressure. However, the pump control means may be of any other suitable mechanism so long as it can make control so that the pump delivery pressure is held higher than higher one of the load pressures of the first and second actuators 19, 21. Other type pump control means include, for example, means for directly controlling the pump delivery pressure by the use of an unloading valve, and means for receiving the input amount of a control lever and controlling the pump delivery rate. The present invention can also be applied to the cases using such other type pump control means, with the result of similar advantages.

INDUSTRIAL APPLICABILITY

According to the present invention constructed as explained above, upon shift from the sole operation of the second actuator of lower load pressure to the combined operation of the first actuator of higher load pressure and the second actuator of lower load pressure, the flow rate of the hydraulic fluid supplied to the second actuator of lower load pressure can be prevented from reducing transiently, making it possible to realize an improvement in working efficiency.

Also, during the combined operation, the hydraulic fluid can be supplied to the actuator on the lower pressure side at a sufficient flow rate, with the result of improved working efficiency during the combined operation.

Further, since the hydraulic fluid from the first hydraulic pump is supplied to the second actuator without passing any pressure control valve, the pressure loss caused by the presence of such a pressure control valve can be suppressed and generation of heat can be held down, thereby improving heat balance in the circuit. Further, the energy loss in the first hydraulic pump can be suppressed, which contributes to a reduction in the fuel cost of the prime mover for driving the first hydraulic pump.

In addition, even when the load pressures of the first and second actuators are reversed in their magnitudes, the above advantages can be provided during the combined operation and upon shift from the sole operation of the actuator of lower load pressure to the combined operation.

We claim:

1. A hydraulic drive system for a construction machine comprising at least first and second hydraulic pumps (25*a*, 25*b*), at least first and second actuators (19, 21) driven by a hydraulic fluid supplied from said first and second hydraulic pumps, first and second valve apparatus (50, 51) respectively disposed between said first and second hydraulic pumps and said first and second actuators for selectively controlling operation of said first and second actuators, and first and second pump control means (30*a*, 30*b*) for respectively controlling said first and second hydraulic pumps so that pump delivery pressures are held higher than higher one of load pressures of said first and second actuators, said first and second_valve apparatus respectively including first and second flow control means (11*a*, 11*b*, 12*a*, 12*b*), first and second pressure control means (13*a*, 13*b*, 15*b*), and first and second directional control means arranged in this order, said hydraulic drive system further comprising a pressure signal transmitting line (52) for introducing, as a pressure signal, higher one of the load pressures of said first and second actuators to said first and second pressure control means, said first and second pressure control means being operated in response to said pressure signal to respectively control pressures downstream of said first and second flow control means, wherein:

said first flow control means includes first and second flow control valves (11*a*, 11*b*) and first interlock means (54, 55) for interlocking said first and second flow control valves with said first directional control means (7), and said second flow control means includes third and fourth flow control valves (12*a*, 12*b*) and second interlock mechanism (56, 57) for interlocking said third and fourth flow control valves with said second directional control means (9), said first pressure control means includes at least first pressure control valve (13*a*) operated in response to said pressure signal in a valve-closing direction, and said second pressure control means includes only second pressure control valve (15*b*) operated in response to said pressure signal in a valve-closing direction, and said first hydraulic pump (25*a*) is connected to said first actuator (19) via said first flow control valve (11*a*), said first pressure control valve (13*a*) and said first directional control means (7), said second hydraulic pump (25*b*) is connected to said first actuator (19) via said second flow control valve (11*b*) and said first directional control means (7), said first hydraulic pump (25*a*) is also connected to said second actuator (21) in parallel to said first actuator (19) via said third flow control valve (12*a*) and said second directional control means (9) without passing any pressure control valve, and said second hydraulic pump (25*b*) is also connected to said second actuator (21) in parallel to said first actuator (19) via said fourth flow control valve (12*b*), said second pressure control valve (15*b*) and said second directional control means (9).

2. A hydraulic drive system for a construction machine according to claim 1, wherein said first pressure control mechanism further includes a third pressure control valve (13*b*) operated in response to said pressure signal in a valve-closing direction, and said second hydraulic pump (25*b*) is connected to said first actuator (19) via said second flow control valve (11*b*), said third pressure control valve (13*b*) and said first directional control means (7).

3. A hydraulic drive system for a construction machine according to claim 1, wherein said first pressure control means includes only said first pressure control valve (13*a*), and said second hydraulic pump (25*b*) is connected to said first actuator (19) via said second flow control valve (11*b*) and said first directional control means (7) without passing any pressure control valve.

4. A hydraulic drive system for a construction machine according to claim 1, wherein lines downstream of said first and second flow control valves (11*a*, 11*b*) are connected to each other such that the hydraulic fluid delivered from said first hydraulic pump (25*a*) and the hydraulic fluid delivered from said second hydraulic pump (25*b*) join together between said first pressure control valve (13*a*) and said first directional control means (7), while lines downstream of said third and fourth flow control valves (12*a*, 12*b*) are connected to each other such that the hydraulic fluid delivered from said first hydraulic pump (25*a*) and the hydraulic fluid delivered from said second hydraulic pump (25*b*) join together between said second pressure control valve (15*b*) and said second directional control means (9).

5. A hydraulic drive system for a construction machine according to claim 1, wherein lines downstream of said first and second flow control valves (11*a*, 11*b*) are connected to each other such that the hydraulic fluid delivered from said first hydraulic pump (25*a*) and the hydraulic fluid delivered from said second hydraulic pump (25*b*) join together between said first directional control means (7*a*, 7*b*) and said first actuator (19), while lines downstream of said third and fourth flow control valves (12*a*, 12*b*) are connected to each other such that the hydraulic fluid delivered from said first hydraulic pump (25*a*) and the hydraulic fluid delivered from said second hydraulic pump (25*b*) join together between said second directional control means (9*a*, 9*b*) and said second actuator (21).

6. A hydraulic drive system for a construction machine according to claim 1, wherein said first and second pump control means respectively include first delivery rate control means (30*a*) for controlling a delivery rate of said first hydraulic pump (25*a*) so that a pump delivery pressure is held higher than said pressure signal and second delivery rate control means (30*b*) for controlling a delivery rate of said second hydraulic pump (25*b*) so that a pump delivery pressure is held higher than said pressure signal.

* * * * *